US012593929B2

(12) United States Patent
Jewett

(10) Patent No.: US 12,593,929 B2
(45) Date of Patent: Apr. 7, 2026

(54) BEDDING OR SEATING PRODUCT AND METHOD OF DISASSEMBLING PRODUCT

(71) Applicant: L&P Property Management Company, South Gate, CA (US)

(72) Inventor: Jason V Jewett, Carthage, MO (US)

(73) Assignee: L&P Property Management Company, Carthage, MO (US)

( * ) Notice: Subject to any disclaimer, the term of this patent is extended or adjusted under 35 U.S.C. 154(b) by 190 days.

(21) Appl. No.: 18/501,372

(22) Filed: Nov. 3, 2023

(65) Prior Publication Data

US 2025/0143479 A1 May 8, 2025

(51) Int. Cl.
*A47C 27/06* (2006.01)
*A47C 27/07* (2006.01)
*A47C 27/15* (2006.01)

(52) U.S. Cl.
CPC ..... *A47C 27/064* (2013.01); *A47C 27/07* (2013.01); *A47C 27/15* (2013.01)

(58) Field of Classification Search
CPC ..... A47C 27/064; A47C 27/07; A47C 27/05; A47C 7/35; A47C 27/063; A47C 27/0456
USPC ..... 5/716
See application file for complete search history.

(56) References Cited

U.S. PATENT DOCUMENTS

| | | | | |
|---|---|---|---|---|
| 7,640,611 | B1 * | 1/2010 | Kluft | A47C 27/064 5/718 |
| 11,013,340 | B2 | 5/2021 | Jewett et al. | |
| 11,015,274 | B2 | 5/2021 | James et al. | |
| 11,015,275 | B2 | 5/2021 | James et al. | |
| 11,111,615 | B2 | 9/2021 | James et al. | |
| 11,578,441 | B2 | 2/2023 | James et al. | |
| 11,771,235 | B2 | 10/2023 | Jewett et al. | |
| 2010/0212090 | A1 * | 8/2010 | Stjerna | A47C 27/064 29/91 |
| 2019/0343294 | A1 | 11/2019 | DeMoss et al. | |
| 2019/0357694 | A1 * | 11/2019 | Jewett | A47C 7/35 |
| 2021/0368999 | A1 | 12/2021 | Papegaaij et al. | |
| 2022/0087441 | A1 * | 3/2022 | Tan | B68G 9/00 |
| 2023/0270262 | A1 | 8/2023 | Jewett et al. | |

FOREIGN PATENT DOCUMENTS

| | | | |
|---|---|---|---|
| CN | 211608884 | U | 10/2020 |
| CN | 211608894 | U | 10/2020 |

OTHER PUBLICATIONS

International Search Report, International Searching Authority, in regard to International Application No. PCT/US2024/050312, dated Feb. 13, 2025, 5 Pages.

* cited by examiner

*Primary Examiner* — Justin C Mikowski
*Assistant Examiner* — George Samuel Gines
(74) *Attorney, Agent, or Firm* — Wood Herron & Evans LLP

(57) ABSTRACT

A bedding or seating product comprises a pocketed spring assembly glued to a cushion assembly. The product may be quickly and easily separated into its component parts for recycling. The pocketed spring assembly comprises a plurality of parallel strings of individually pocketed springs and a lower sheet glued to lower surfaces of at least some of the strings. The cushion assembly comprises at least one cushion layer and a connector sheet sewn together without any glue. The connector sheet is glued to upper surfaces of the strings of the pocketed spring assembly.

19 Claims, 9 Drawing Sheets

BEDDING OR SEATING PRODUCT AND METHOD OF DISASSEMBLING PRODUCT

FIELD OF THE INVENTION

This invention relates generally to bedding and seating products and, more particularly, to bedding and seating products having components which may be easily separated for recycling.

BACKGROUND OF THE INVENTION

Mattress spring core construction over the years has been a continuously improving art with advancements in materials and machine technology. A well-known form of spring core construction is known as a Marshall spring construction wherein metal coil springs are encapsulated in individual pockets of fabric and formed as elongate or continuous strings of individually pocketed coil springs. Due to the fabric used in pocketed spring assemblies being weldable to itself, these strings of pocketed springs are manufactured by folding an elongate piece of fabric in half lengthwise to form two plies of fabric and thermally or ultrasonically welding transverse and longitudinal seams to join the plies of fabric to define pockets within which the springs are enveloped. One such fabric is a non-woven polypropylene fabric.

Once strings of pocketed springs are constructed, they may be assembled to form a pocketed spring assembly for a mattress, cushion, or the like by a variety of methods. For example, multiple or continuous strings may be arranged in a row pattern corresponding to the desired size and shape of a mattress or the like, and adjacent rows of strings may be interconnected by a variety of methods. The result is a unitary assembly of individually pocketed coil springs, referred to as a pocketed spring assembly.

The current method of assembling a mattress or other bedding or seating product is to use adhesive to adhere a cushion layer to an upper surface of a pocketed spring assembly to create a one-sided mattress. To create a two-sided mattress adhesive is used to adhere a cushion layer to both upper and lower surfaces of a pocketed spring assembly. Each cushion layer usually includes a foam layer which may be made of polyurethane or any other known foam components.

Sometimes more than one cushion layer may be used to create a cushion subassembly. The components of the cushion subassembly are glued together as a subassembly and the completed cushion subassembly adhered to an outer surface of the pocketed spring assembly with adhesive.

An alternative known method of assembling a bedding or seating product comprises using adhesive to adhere one cushion layer to the pocketed spring assembly, then using more adhesive to adhere a second cushion layer to the first cushion layer of the cushion subassembly. Any number of cushion layers may be adhered to each other using adhesive using this method. Known methods of assembling a bedding or seating product including the methods described above present the following problems.

First, adhesive is expensive and the known methods of securing one or more cushion layers to at least one side of a pocketed spring assembly require a great deal of adhesive.

Second, it is difficult and expensive to separate the individual components of a bedding or seating product, such as a mattress, at the end of its useful life. There is currently a strong desire to recycle as much of a bedding or seating product as possible. The adhesive used to join the components makes separation difficult, expensive, laborious and sometimes impossible. Depending upon a number of factors, separating the materials may be economically prohibitive.

Third, the metal coil springs may be difficult to separate from the fabric in which they are encased so that the metal may be reused or recycled apart from the fabric.

The present invention solves these each of these problems. The amount of adhesive is reduced in the bedding or seating product of this invention because the cushion layers are sewn or quilted together rather than glued together. The quilting machine(s) disclosed in applicant's U.S. Pat. Nos. 11,015,274; 11,015,275; 11,111,615 and 11,578,441, which are each fully incorporated by reference herein, is/are able to stich multiple cushion layers together without using adhesive to create a cushion subassembly. However, the cushion subassembly must be secured to the pocketed spring assembly.

Secondly, when the product reaches the end of its life, the cushion layers above the lowermost sheet of a cushion subassembly may be quickly and easily separated from each other at low cost for recycling. The bottom sheet of the cushion subassembly may remain adhesively secured to the pocketed spring assembly after the stitches are removed from the cushion subassembly. Thus, the bottom sheet of the cushion subassembly may be recycled with the material of the strings of the pocketed spring assembly. Preferably, both are made of the same material.

The present bedding or seating product further enables the metal of the coil springs to be easily separated from the fabric of the pocketed spring assembly. The fabric of the pocketed spring assembly may be perforated, enabling a person to open the pockets of the pocketed spring assembly to remove metal coil springs from the fabric pockets. A lower sheet of the pocketed spring assembly provides a gripping surface so a user may tear the perforated fabric of the strings of pocketed springs to open the pockets and allow the metal coil springs to be removed and recycled.

Upon disassembly, the result is three groups: 1) a fabric carcass of one material including the adhesive; 2) at least one comfort layer, each of which is commonly a foam layer and 3) the metal coil springs. Each group may be separately recycled or reused.

Thus, the present invention enables a mattress or other bedding or seating product to be separated into multiple materials which may be separately recycled. The entire mattress may be recycled without any waste, thereby saving landfill space, time and money. The disassembly method described herein optimizes the efficiency of the recycling process and reduces the environmental impact of disposing of a used mattress or other bedding or seating product.

SUMMARY OF THE INVENTION

In one aspect, a bedding or seating product comprises a pocketed spring assembly and a cushion assembly joined together with adhesive. The pocketed spring assembly comprises a plurality of pocketed springs joined to a lower sheet. Each of the pocketed springs comprises a metal spring inside a fabric pocket. The fabric pockets have perforations at least partially around the fabric pockets.

The lower sheet is attached to a lower surface of the pocketed spring assembly. The lower sheet extends outwardly from a pocketed spring core, thus creating picture frame shaped perimeter portion which may be easily grabbed by a user to handle the pocketed spring assembly.

The lower sheet of the pocketed spring assembly may be made of the same material or fabric as the fabric pockets. The lower sheet of the pocketed spring assembly may be made of same material or fabric as the fabric of the connector sheet described below. In some embodiments, each of these fabrics may be non-woven polypropylene.

The bedding or seating product further comprises a cushion assembly comprising at least one foam layer and a connector sheet sewn together. The connector sheet may be made of non-woven polypropylene.

An upholstered covering may encase the pocketed spring assembly and cushion assembly which together may be considered a product interior for purposes of this document.

In another aspect, a bedding or seating product comprises a pocketed spring assembly comprising a plurality of parallel strings of springs joined together. Each of the strings comprises a plurality of individually pocketed springs. Each of the strings comprises a piece of fabric joined to itself along a longitudinal seam and has first and second opposed plies of fabric on opposite sides of the springs. A plurality of pockets is formed along a length of the string by transverse seams joining the first and second plies. At least spring is positioned in each of the pockets. A lower sheet is attached to a lower surface of at least some of the strings. The strings have perforations at least partially around the strings.

A cushion assembly comprising multiple cushion layers including a connector sheet are sewn together. The connector sheet of the cushion assembly is attached to at least some of the strings of the pocketed spring assembly.

In another aspect, a method of disassembling a pocketed spring assembly comprises removing thread from a cushion assembly to separate cushion layers from each other. The cushion assembly includes a connector sheet glued to a pocketed spring assembly. The method further comprises tearing fabric along perforations in strings of individually pocketed springs of the pocketed spring assembly by pulling a lower sheet of the pocketed spring assembly away from the connector sheet of the cushion assembly. The pocketed spring assembly comprises a plurality of parallel strings of springs joined together. Each of the strings comprises a plurality of individually pocketed springs. Each of the strings further comprises a piece of fabric joined to itself along a longitudinal seam, first and second opposed plies being on opposite sides of the springs. A plurality of pockets is formed along a length of the string by transverse seams joining the first and second plies. At least one spring is positioned in each of the pockets. The method further comprises removing the springs from the pockets of the strings. Preferably, the lower sheet of the pocketed spring assembly is thicker than the connector sheet of the cushion assembly, although they may be the same thickness. Preferably, they are made of the same material. However, the lower sheet of the pocketed spring assembly may be made of a different material than the connector sheet of the cushion assembly. The glue/adhesive used in the pocketed spring assembly to join strings together and used to join the connector sheet to the pocketed spring assembly preferably is made at least partially of the same material as the connector sheet of the cushion assembly and the lower sheet of the pocketed spring assembly and the fabric of the strings of the pocketed spring assembly.

In another aspect, a method of disassembling a pocketed spring assembly comprises removing thread from a cushion assembly to separate cushion layers from each other. The cushion assembly includes a connector sheet glued to a pocketed spring assembly. The method further comprises tearing fabric along perforations in strings of individually pocketed springs of the pocketed spring assembly using a lower sheet of the pocketed spring assembly. The method last comprises removing springs from the pockets of the strings which have been opened due to the tearing step.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
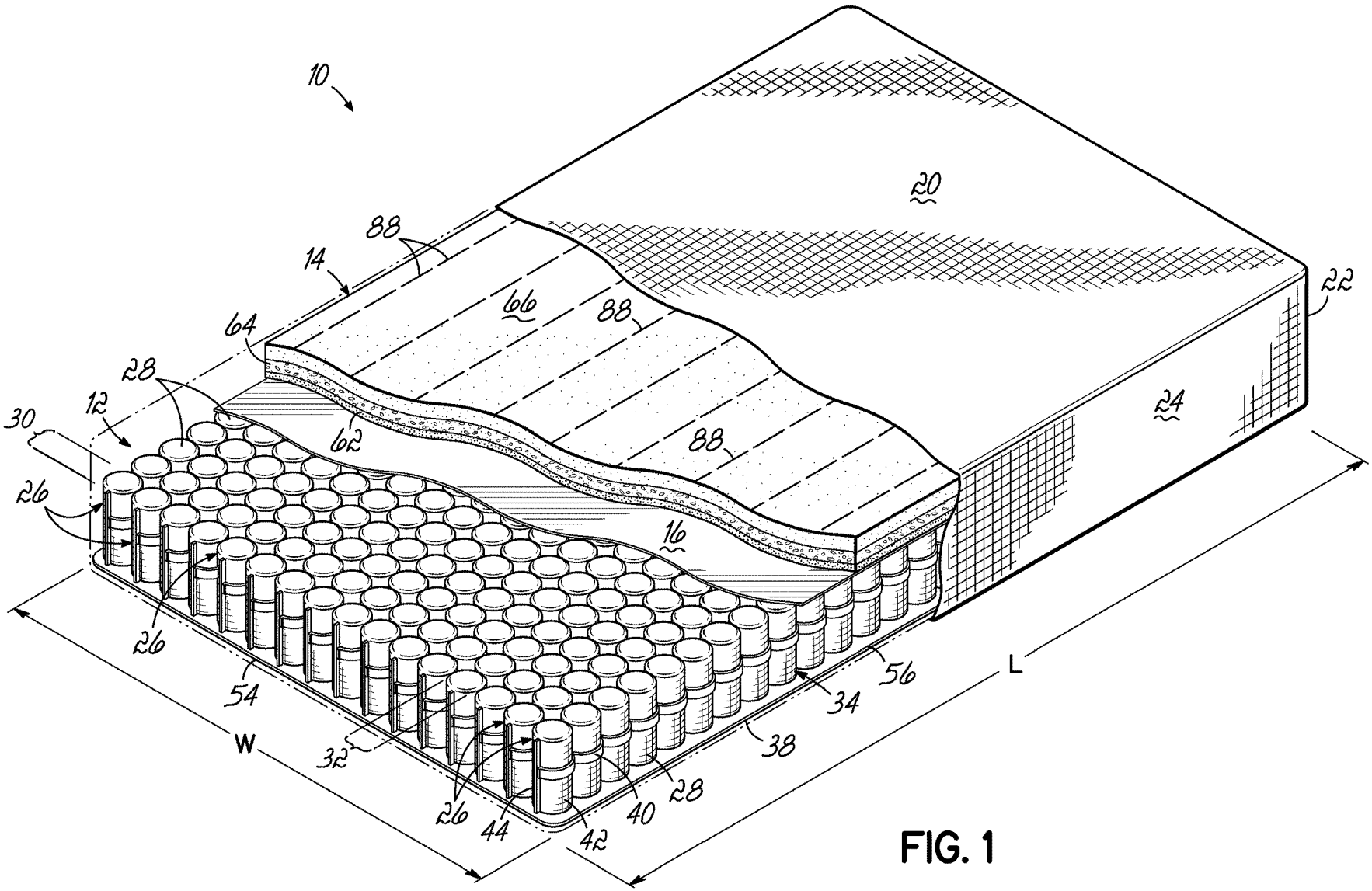
FIG. 1 is a perspective view, partially broken away, of a bedding or seating product incorporating a pocketed spring assembly joined to a cushion assembly according to the principles of the present invention.

Referring to FIG. 1, there is illustrated a bedding product in the form of a single-sided mattress 10 incorporating the principles of the present invention. This product or mattress 10 comprises a pocketed spring assembly 12 glued to a cushion assembly 14, to form a product assembly 15. An upholstered cover 20 surrounds the product assembly 15 including the pocketed spring assembly 12 and cushion assembly 14 glued together.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1, the length is illustrated as being greater than the width. However, it is within the scope of the present invention that the length and width may be identical, as in a square product.

Figure 4:
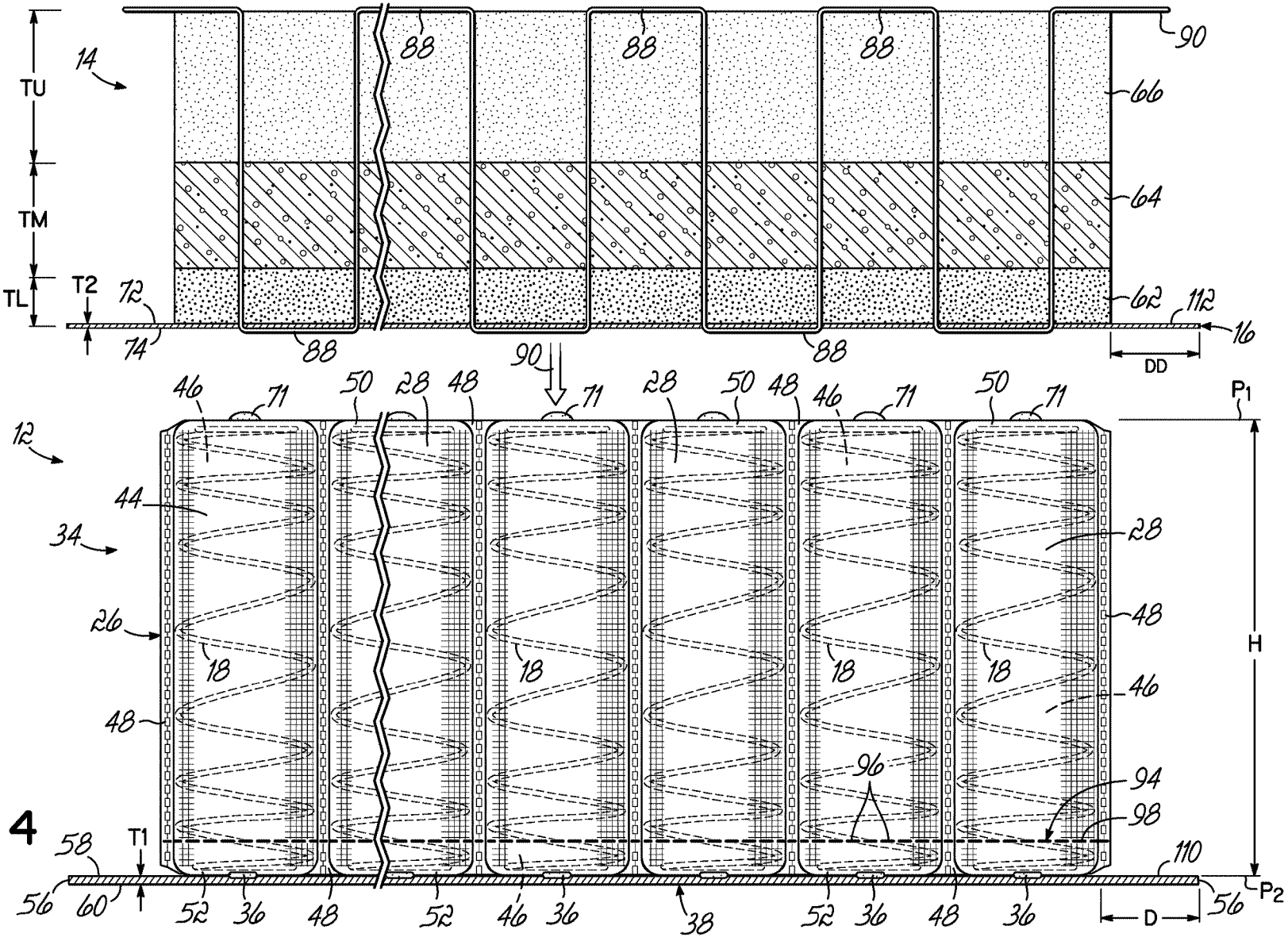
FIG. 4 is a cross-sectional view, partially broken away, of the cushion assembly being secured to the pocketed spring assembly.

As shown in FIG. 1, pocketed spring assembly 12 comprises a pocketed spring assembly core 34 and a lower sheet 38. The pocketed spring assembly core 34 is manufactured from multiple strings 26 of pocketed springs 28 joined together in any known manner, such as by gluing for example. Although pocketed springs 28 are typically metal coil springs 18 (as shown in FIG. 4), the springs may be any resilient members including foam, for example. Although one configuration of metal coil spring 18 is illustrated, any known configuration of spring may be used. The invention is not limited to coil springs.

Although the strings 26 of pocketed springs 28 are commonly arranged in transversely extending rows 30 and longitudinally extending columns 32, as shown in FIG. 1, they may be offset, as is known in the art. The present invention is not intended to limit the configuration or type of pocketed spring assembly core 34 to those illustrated.

As best shown in FIG. 1, each string 26 extends longitudinally or from head-to-foot along the full length of the pocketed spring assembly core 34. Although the strings 26 are illustrated as extending longitudinally or from head-to-foot in the pocketed spring assembly 12 of FIG. 1, they may extend transversely or from side-to-side as is known in the art. In any of the embodiments shown or described herein, the strings may extend either longitudinally (from end-to-end) or transversely (from side-to-side).

Figure 4A:
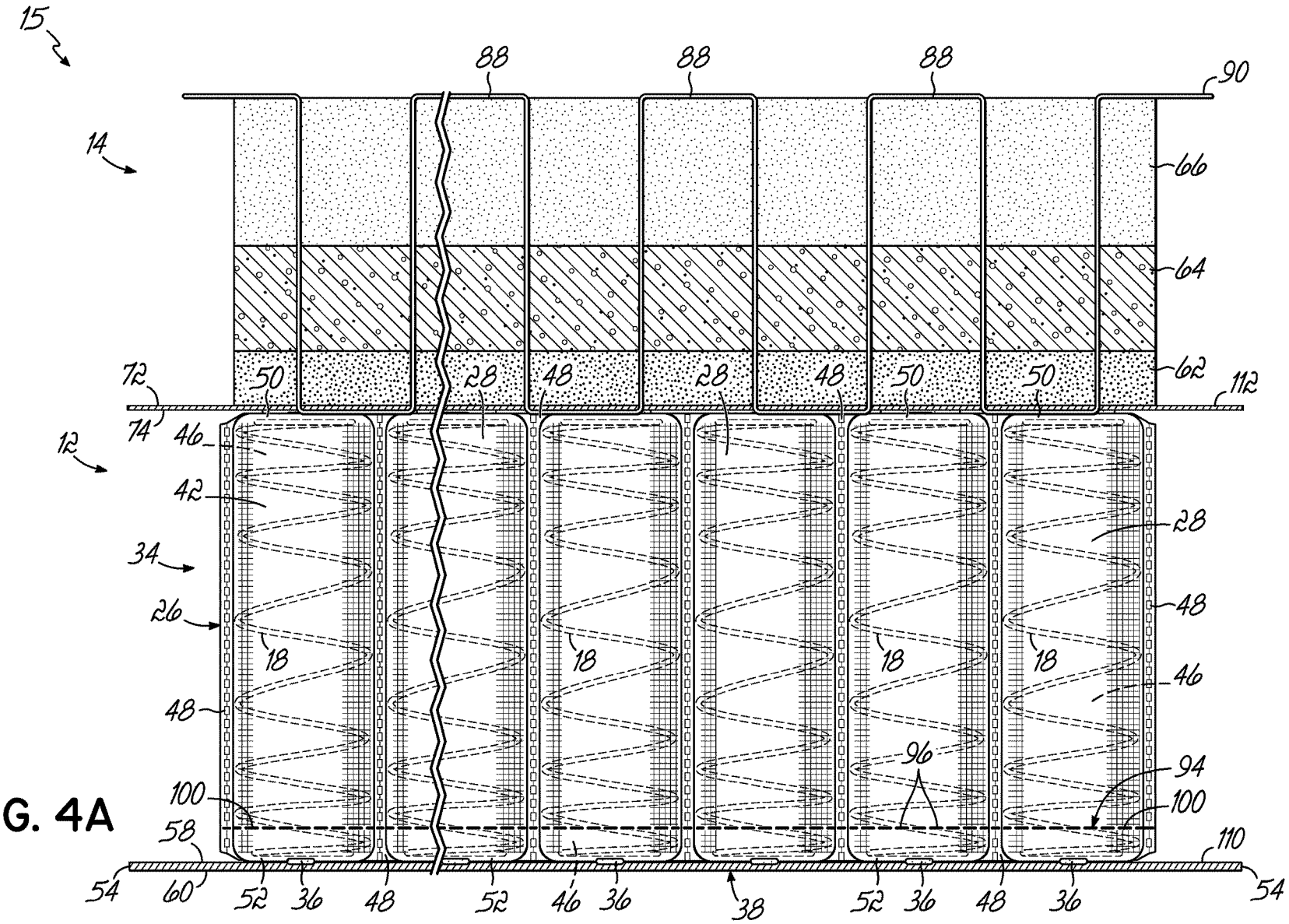
FIG. 4A is a longitudinal cross-sectional view, partially broken away, of the cushion assembly secured to the pocketed spring assembly.
Figure 4B:
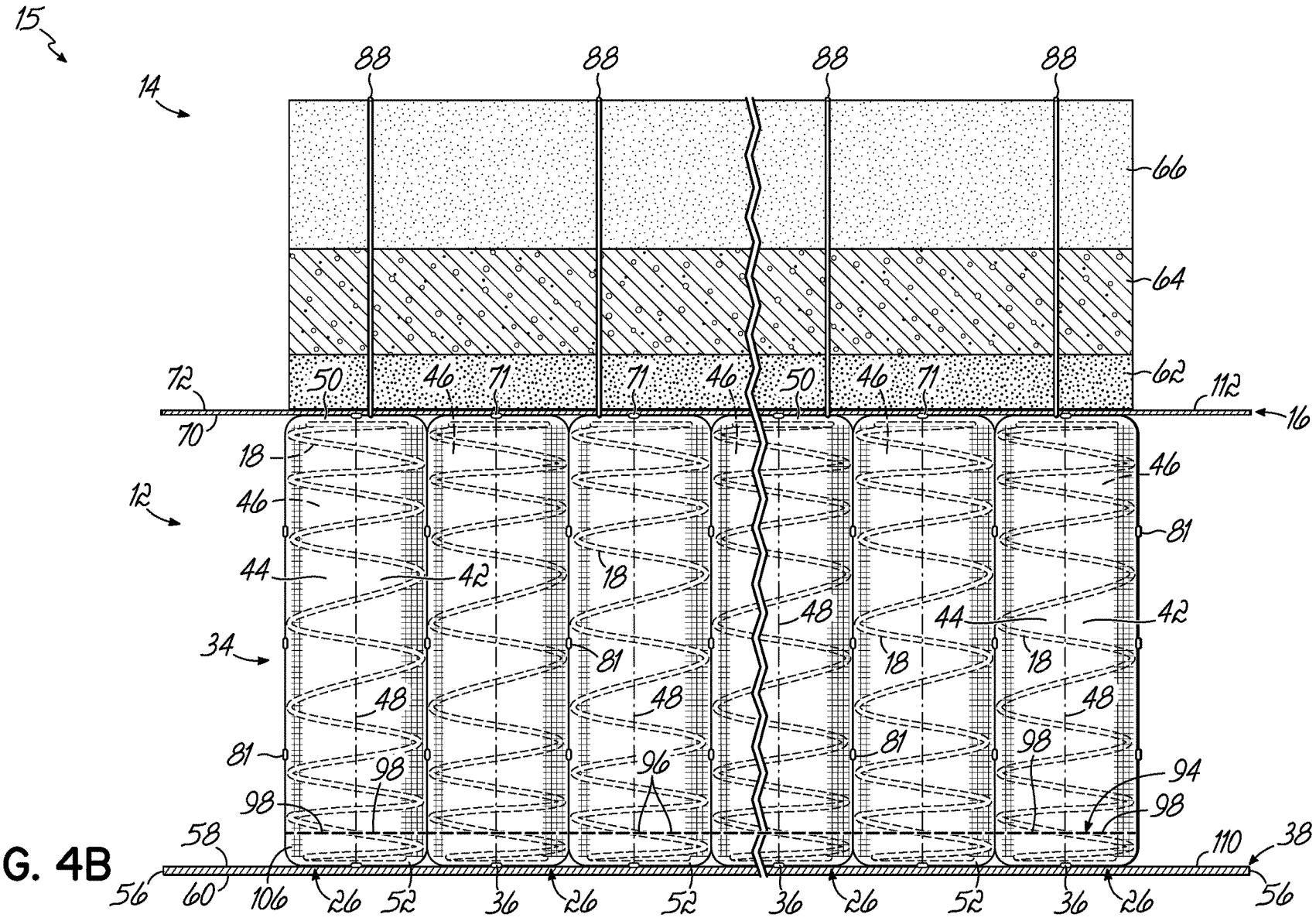
FIG. 4B is a transverse cross-sectional view, partially broken away, of the cushion assembly secured to the pocketed spring assembly.
Figure 5:
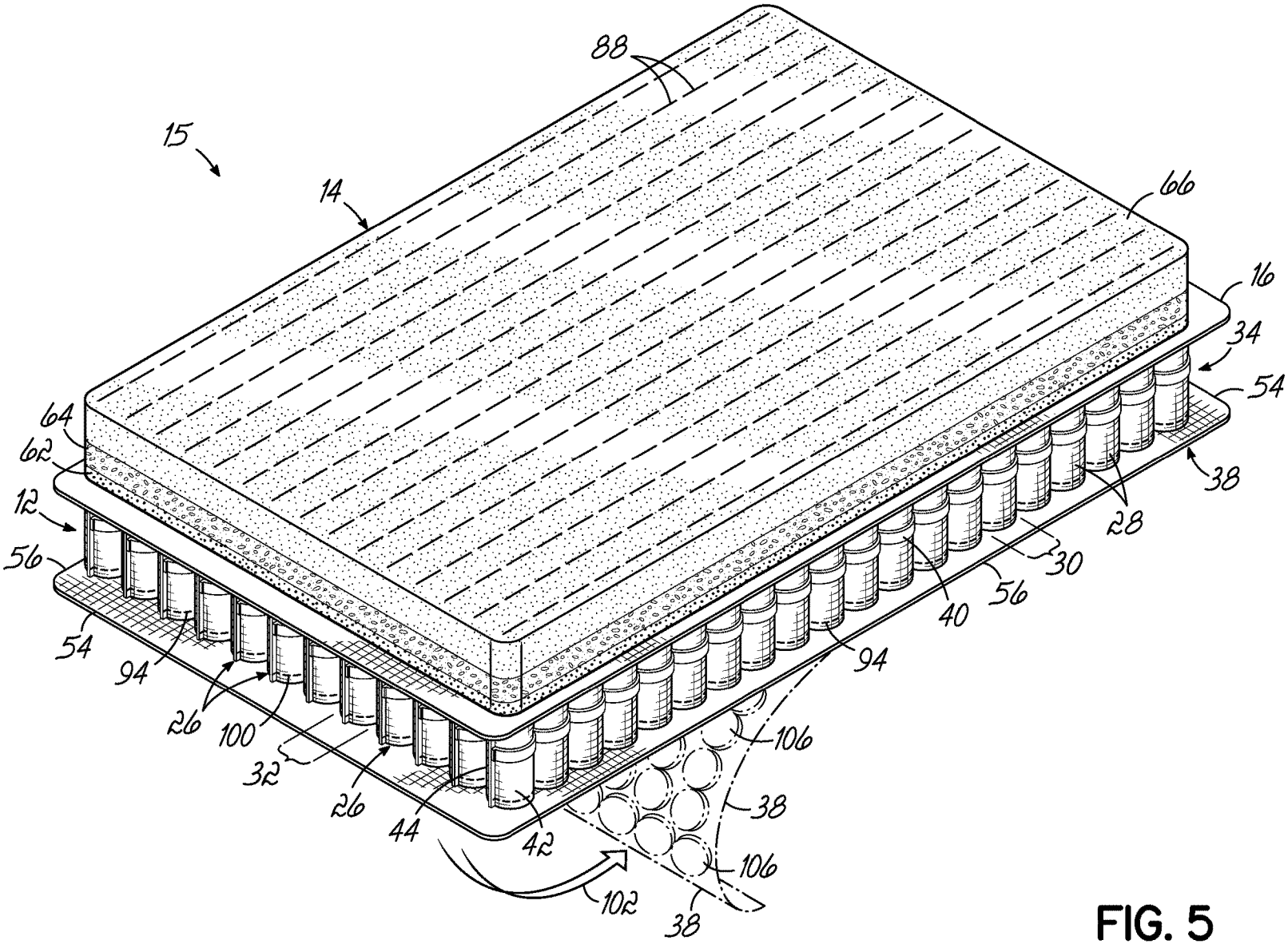
FIG. 5 is a perspective view of the pocketed spring assembly of FIG. 4B being torn apart to separate the springs from the fabric.

As best shown in FIGS. 1 and 5, each string 26 of pocketed spring assembly core 34 comprises a piece of fabric joined along a longitudinal seam 40. As best shown in FIGS. 1 and 4B, first and second opposed plies of fabric 42, 44 are on opposite sides of the springs 18, a plurality of pockets 46 being formed along a length of the string 26 by transverse seams 48 joining said first and second plies 42, 44. At least one spring 18 is positioned in each pocket 46. Although one type of spring 18 is shown, any spring may be incorporated into any of the pockets 46.

As best shown in FIG. 4, each string 26 of pocketed spring assembly core 34 has an upper surface 50 and a lower surface 52. As best shown in FIG. 4A, the upper surfaces 50 of the strings 26 of pocketed spring assembly core 34 are generally co-planar in an upper plane P1 and the lower surfaces 52 of the strings 26 of pocketed spring assembly core 34 are generally co-planar in a lower plane P2. The linear distance between upper and lower surfaces 50, 52 of the strings 26 of pocketed spring assembly core 34 is defined as the height "H" of the pocketed spring assembly core 34 because all the strings 26 are the same height.

As best shown in FIG. 4, lower sheet 38 is secured to a lower surface 52 of at least some of the strings 26 of pocketed spring assembly core 34 with adhesive/glue beads 36. The adhesive beads 36 securing the strings 26 of pocketed spring assembly core 34 to the lower sheet 38 may be beads, lines or segments of glue or adhesive.

As best shown in FIG. 1, lower sheet 38 has a length "L" defined as the linear distance between opposed end edges 54 (only one being shown in FIG. 1). Similarly, the lower sheet 38 has a width "W" defined as the linear distance between opposed side edges 56. In the pocketed spring assembly 12 shown, the length is illustrated as being greater than the width. However, it is within the scope of the present invention that the length and width may be identical, as in a square pocketed spring assembly. As shown in FIGS. 4, the lower sheet 38 has a thickness "T1" defined as the linear distance between opposed top and bottom surfaces 58, 60, respectively. In one embodiment, the thickness T1 of the lower sheet 38 is 0.032 inches but may be any desired thickness.

Lower sheet 38 is preferably made of a non-woven polypropylene fabric which is commonly the material from which the strings 26 of pocketed spring assembly core 34 are made. The lower sheet 38 may be the same sheet defined as a dimensionally stabilizing substrate defined in U.S. patent application Ser. Nos. 18/469,644; 17/244,021; 18/313,470 or U.S. Pat. Nos. 11,013,340 and 11,771,235, each of which is incorporated by reference herein.

As best shown in FIG. 4, the lower sheet 38 extends outwardly from the pocketed spring core 34 a distance "D", thus creating a picture frame shaped perimeter portion 110 which may be easily grabbed by a user to handle the pocketed spring assembly 12. To disassembly the product 10 as described below, a user grabs the perimeter portion 110 to tear the pockets 46 of strings 26 open to separate the metal coil springs 18 from the fabric of the strings 26.

Strings 26 and any other strings of springs described or shown herein, may be connected in side-by-side relationship as, for example, by gluing the sides of the strings together in an assembly machine, to create an assembly or matrix of springs having multiple rows and columns of pocketed springs 28 bound together as by gluing, welding or any other conventional assembly process commonly used to create pocketed spring cores or assemblies.

Figure 2:
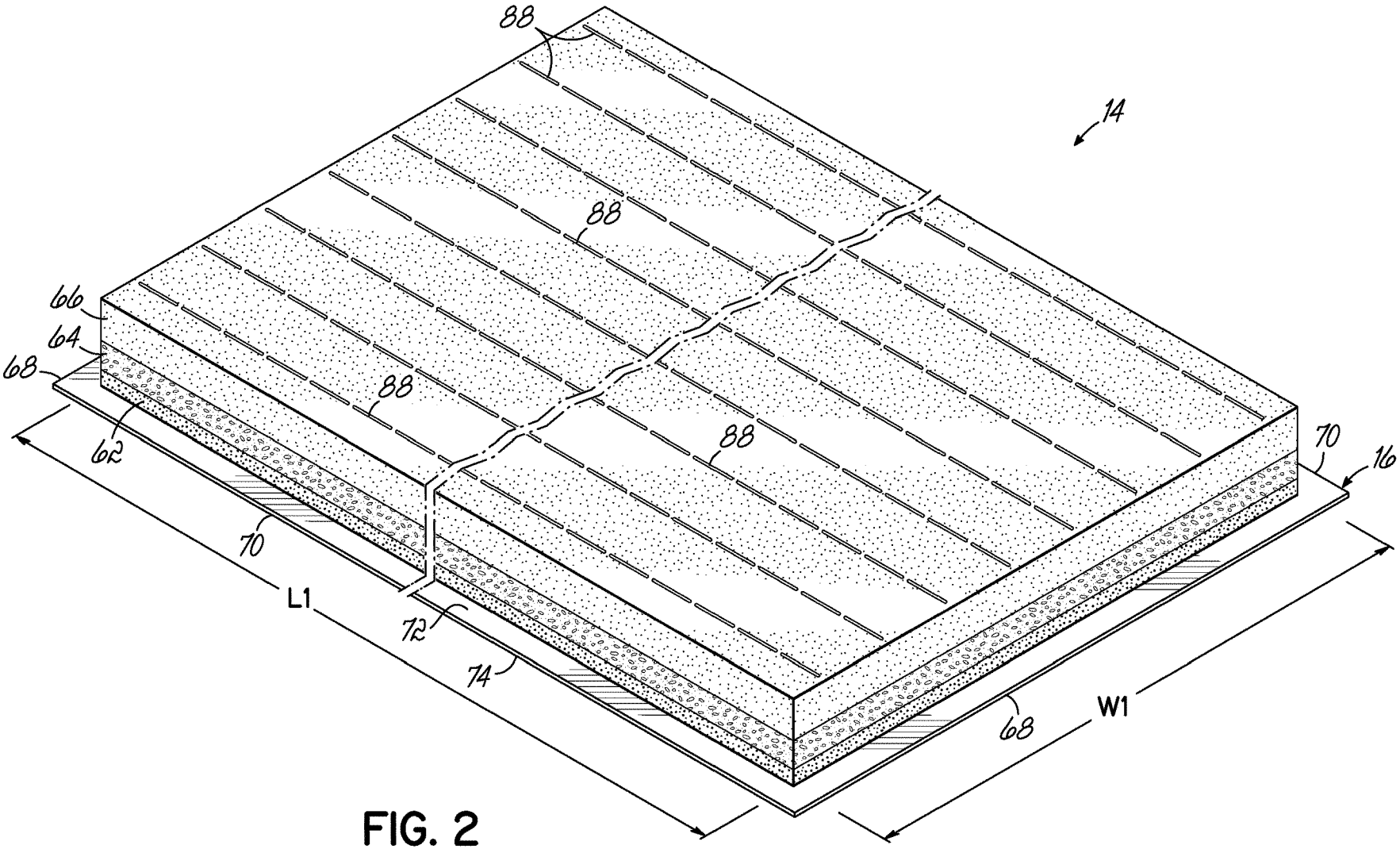
FIG. 2 is a perspective view, partially broken away, of the cushion assembly of the mattress of FIG. 1.
Figure 3:
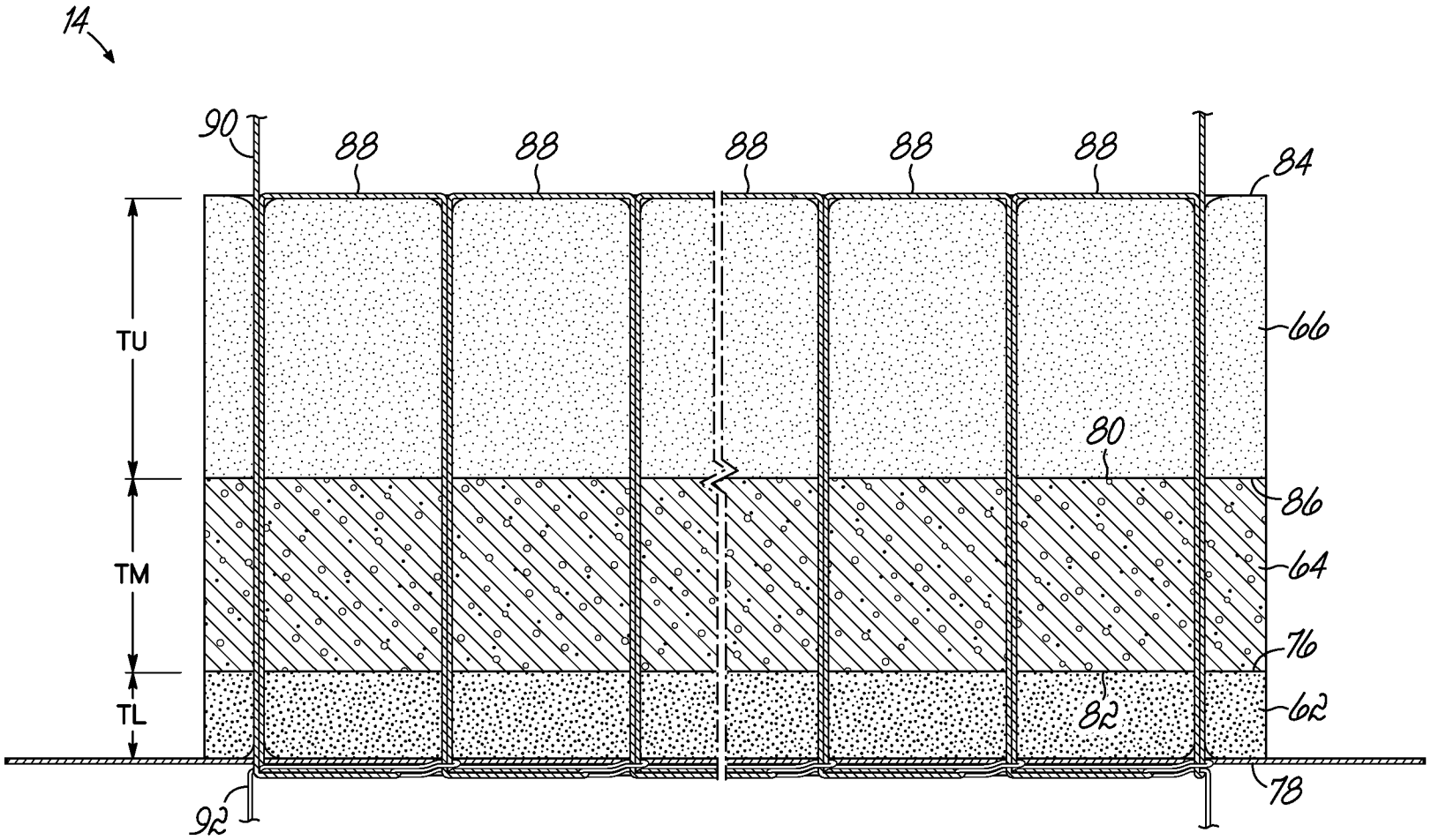
FIG. 3 is a cross-sectional view, partially broken away, of the cushion assembly of FIG. 2.

FIGS. 2 and 3 show in detail the cushion assembly 14. The cushion assembly 14 comprises a connector sheet 16 at the bottom thereof and three cushion layers; a bottom cushion layer 62, a middle cushion layer 64 and an upper cushion layer 66.

Although the drawings illustrate three cushion layers 62, 64, 66 and connector sheet 16 being sewn together, any number of cushion layers may be sewn together with a connector sheet 16.

Similarly, as best shown in FIGS. 4A and 4B, connector sheet 16 is approximately the same size as the lower sheet 38 of the pocketed spring assembly 12. As best shown in FIG. 2, the connector sheet 16 has a length "L1" defined as the linear distance between opposed end edges 68. Similarly, the connector sheet 16 has a width "W1" defined as the linear distance between opposed side edges 70 (only one being shown in FIG. 2). In the cushion assembly 14 shown in FIG. 2, the length is illustrated as being greater than the width. However, it is within the scope of the present invention that the length and width may be identical, as in a square cushion assembly. As shown in FIG. 4, the connector sheet 16 has a thickness "T2" defined as the linear distance between opposed top and bottom surfaces 72, 74, respectively. In one embodiment, the thickness T2 of the connector sheet 16 is 0.009 inches, but may be any desired thickness.

Although the connector sheet 16 is illustrated as being thinner than the lower sheet 38 of pocketed spring assembly 12, they may be same thickness. In most embodiments, the lower sheet 38 of pocketed spring assembly 12 is thicker than the connector sheet 16 of cushion assembly 14.

Each of the three cushion layers is illustrated as being a different thickness than the other two cushion layers. As shown in FIG. 6B, lower cushion layer 62 has a thickness "TL" defined the linear distance between a generally planar upper surface 76 and a generally planar lower surface 78. As shown in FIG. 6B, middle cushion layer 64 has a thickness "TM" defined the linear distance between a generally planar upper surface 80 and a generally planar lower surface 82. As shown in FIG. 6B, upper cushion layer 66 has a thickness "TU" defined the linear distance between a generally planar upper surface 84 and a generally planar lower surface 86. FIG. 4 also shows these thicknesses.

Lower cushion layer 62 is illustrated as being thinner than the middle cushion layer 64 and the upper cushion layer 66. The upper cushion layer 66 is illustrated as being thicker than the middle cushion layer 64 and lower cushion layer 62. The middle cushion layer 64 is illustrated as being thicker than the lower cushion layer 62 and thinner than the upper cushion layer 66. The thickness of any cushion layer may be different than any other cushion layer. The drawings are not intended to be limiting. Any number, including all, of the cushion layers (no matter the number) may be same thickness.

Although the cushion layers 62, 64, 66 are illustrated as being different types of foam; any number of the cushion layers may be the same foam. In place of foam, one or more of the cushion layers may be at least partially made of fiber, gel, a pocketed spring blanket or any other suitable materials or any combination thereof.

Although the upper and lower surfaces of each piece of foam are illustrated as being generally planar, the cushion layers need not have generally planar surfaces. For example, the pieces of foam may have interlocking surfaces, such as convoluted surfaces or ribbed surfaces.

As best shown in FIGS. 3, 4, 4A and 4B, the cushion layers 62, 64, 66 and connector sheet 16 are not glued together. As best shown in FIG. 3, they are sewn together with chain stitches 88 including needle thread 90 and looper thread 92 as disclosed in U.S. Pat. Nos. 11,015,274; 11,015,275; 11,111,615 and 11,578,441, which are each fully incorporated by reference herein. The quilting machine used to make such chain stitches 88 without compressing the cushion layers is sold by Global Systems Group, a division of Leggett & Platt, Incorporated under the model number XT9. See www.gsgcompanies.com. Any known type of stitching using thread may be used to secure the cushion layers and connector sheet together.

As best shown in FIGS. 4, 4A and 4B, the connector sheet 16 extends outwardly from the cushion layers 66, 64, 62 a distance "DD", thus creating a picture frame shaped perimeter portion 112 which may be easily grabbed by a user to handle the cushion assembly 14. To disassembly the product 10 as described below, a user may grab the perimeter portion 112 to help separate the cushion layers 62, 64, 66 or to assist in any part of the disassembly of the bedding or seating product.

FIGS. 4, 4A and 4B illustrate a method of assembling the product assembly 15 in accordance with the present invention. The cushion assembly 14 is glued to the pocketed spring assembly 12 to create the product assembly 15 which is surrounded by the upholstered covering 20. The upholstered covering 20 may have a fire retardant on the inside thereof.

As best shown in FIG. 4, cushion assembly 14 is lowered in the direction of arrow 91 until the connector sheet 16 of cushion assembly 14 is secured to upper surfaces 50 of at least some of the strings 26 of pocketed spring assembly core 34 with beads 71 of adhesive/glue. Instead of beads, the adhesive securing the connector sheet 16 of cushion assembly 14 to upper surfaces 50 of the strings 26 of pocketed spring assembly core 34 may be lines or segments of glue. FIG. 4A shows the cushion assembly 14 secured to the pocketed spring assembly 12 using the connector sheet 16 of the cushion assembly 14.

As best shown in FIG. 4B, adjacent strings 26 are glued to each other with beads of adhesive 81. Instead of beads, the adhesive securing adjacent strings 26 of pocketed spring assembly core 34 may be lines or segments of glue. Although FIG. 4B shows three levels of glue beads 81, any number of levels of glue may be used to secure adjacent strings 26 together.

As best shown in FIGS. 4, 4A and 4B, each string 26 has a continuous loop 94 of perforations 96 around the entire string 26. FIG. 4A shows one side section 100 of the continuous loop 94 of perforations 96 extending through the piece of fabric used to create each string 26. FIG. 4B shows one end section 98 of the continuous loop 94 of perforations 96 extending through one of the plies 42, 44 of the piece of fabric used to create the string 26. The continuous loop 94 of perforations 96 extends around the entire string 26 facilitating the tearing of the fabric as described herein.

The pocketed spring assembly 12 has one continuous loop 94 of perforations 96 proximate the lower sheet 38 in the lower third of the pocketed spring assembly 12.

Figure 6A:
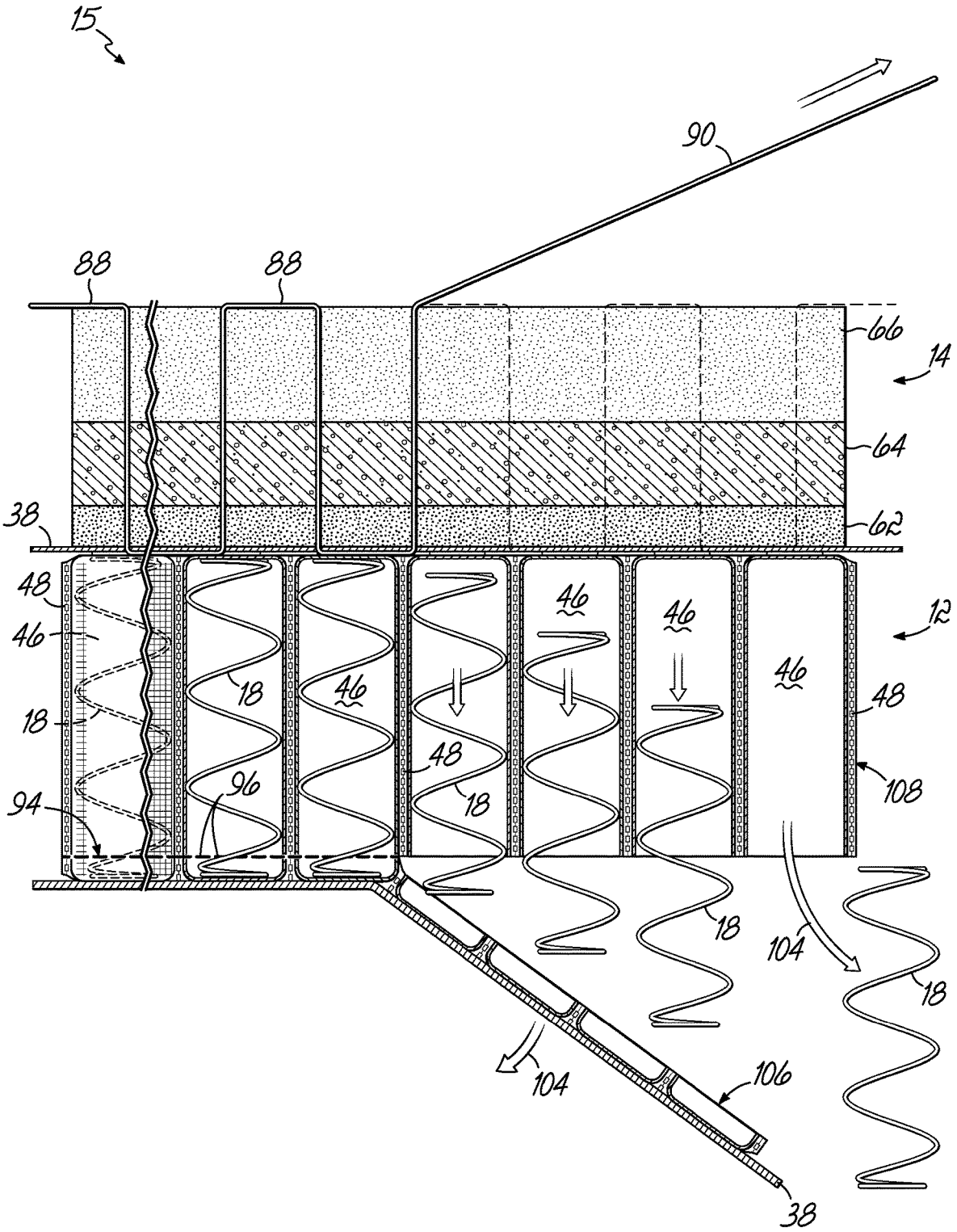
FIG. 6A is a cross-sectional view of the pocketed spring assembly being torn apart and the thread joining the cushion layers being removed.
Figure 6B:
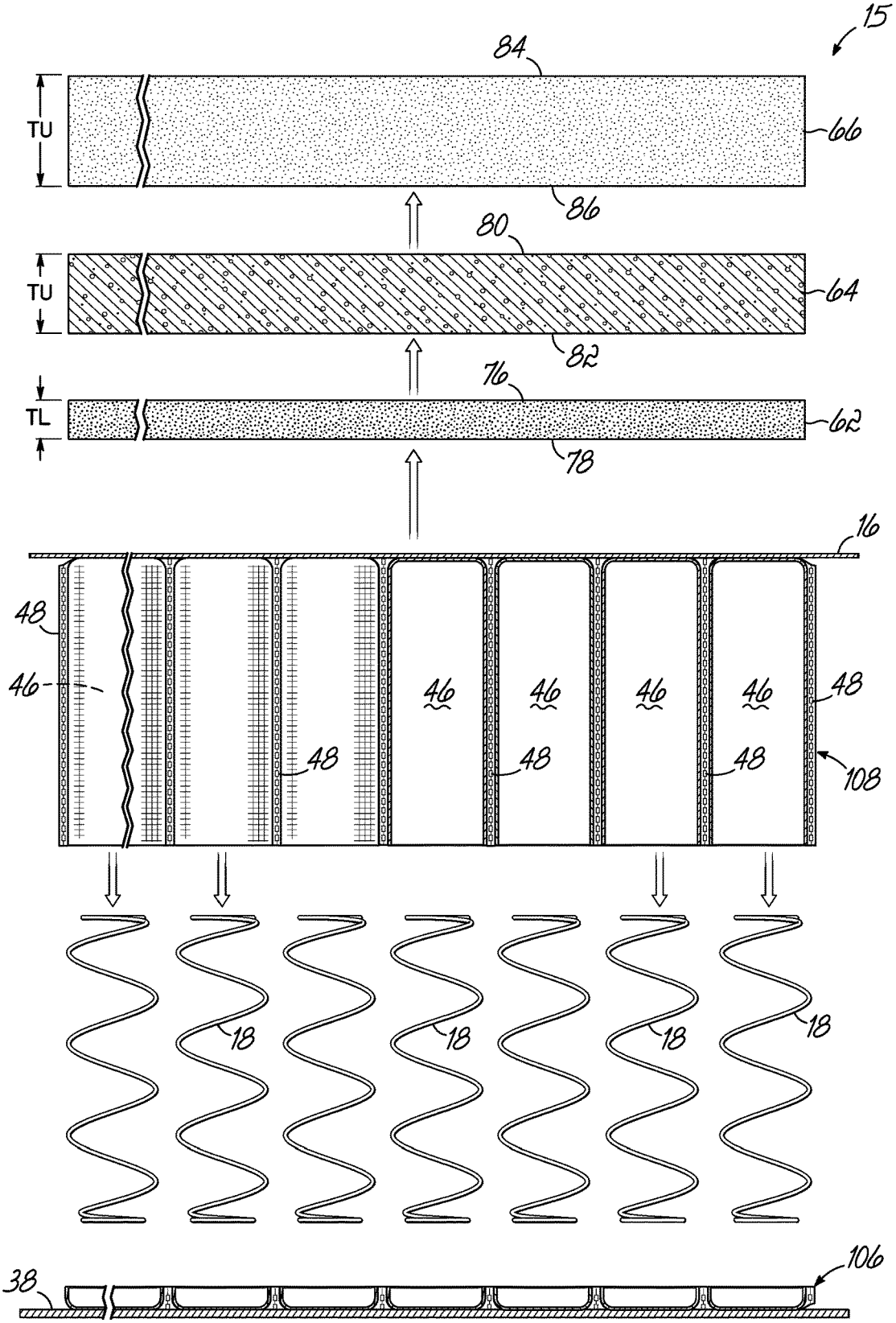
FIG. 6B is a cross-sectional view of the components of the mattress being separated from each other.

FIGS. 5, 6A and 6B show a method of disassembling a bedding or seating product, such as single-sided mattress 10. As shown in FIG. 6A, the needle threads 90 and looper threads 92 are removed from the remainder of the cushion assembly 14 to enable the cushion layers to be separated from each other. As shown in FIG. 6B, the connector sheet 16 remains glued to the upper surfaces 50 of at least some of the strings 26 of the pocketed spring assembly 12. The connector sheet 16 is preferably made of the same fabric or material as the fabric of the strings 26 of the pocketed spring assembly 12 so they may be recycled together without trying to separate the connector sheet 16 from the fabric of the strings 26. In some embodiments, such fabric is non-woven polypropylene.

The disassembly method further comprises tearing the fabric of the strings 26 along perforations 96 in the strings 26 of the pocketed spring assembly 12. Such tearing is achieved by pulling the lower sheet 38 of the pocketed spring assembly 12 away from the connector sheet 16 of the cushion assembly 14. With the lower section 106 of the pocketed spring assembly 12 including the lower sheet 38 separated from the upper section 108 of fabric of the pocketed spring assembly 12, the metal coil springs 18 may be removed from the pockets 46 of the upper section 108 of the fabric of the pocketed spring assembly 12. The metal coil springs 18 may be passed downwardly through openings in the pockets 46 of the upper section 108 of the fabric of the pocketed spring assembly 12 created by the tearing step.

As shown in FIGS. 5 and 6A, the metal coil springs 18 may be separated from the fabric of the pocketed spring assembly 12 by a person or machine grabbing the lower sheet 38 outside the pocketed spring assembly 12 and pulling downwardly in the direction of arrow 102 of FIG. 5. The force created by the person or machine causes the strings 26 of pocketed spring assembly 12 to tear along the continuous loops 94 of perforations 96. After the pockets 46 of strings 26 have been opened by the tearing of the fabric, the coil springs 18 may be removed from inside the pockets 46 either by gravity or machine or manually. See arrow 104 of FIG. 6A.

Tearing is possible because the tensile strength of the pieces of fabric of the strings 26 is less than the tensile strength of the lower sheet 38. In some applications, the tensile strength of the lower sheet 38 is at least twice as great as the tensile strength of the pieces of fabric of the strings 26. In most embodiments, the lower sheet 38 of the pocketed spring assembly 12 has a greater tensile strength than the tensile strength of the fabric of the strings 26 of the pocketed spring assembly 12.

After the metal coil springs 12 have been separated from the fabric by tearing along the perforations 96, the fabric of the pocketed spring assembly 12 is separated into a first or lower section of fabric 106 having the lower sheet 38 and a second or upper section of fabric 108 having the cushion assembly 14 attached thereto. Although the perforations 96 are shown in continuous loops 94 around the strings 26, the perforations 96 may be arranged in other configurations around a string 26. This is true for any of the embodiments shown or described herein. U.S. patent application Ser. No.

18/313,470 discloses this process of tearing the strings along perforations and is fully incorporated by reference herein.

FIG. 6B shows the components of the product assembly after being disassembled. After the needle and looper threads 90, 92 of the cushion assembly 14 have been removed, the upper cushion layer 66 may be separated from the middle cushion layer 64 and lower cushion layer 62. Each cushion layer may be recycled with other like products from other mattresses or bedding products/seating products.

Similarly, after the fabric of the strings 26 of the pocketed spring assembly core 34 has been torn along perforations 96, the lower section 106 of fabric may be separated from the upper section 108 of fabric after the metal coil springs 18 are separated for recycling. Because the connector sheet 16 of the cushion assembly 14 is made of the same material as the fabric of the upper section 108 of the fabric of the pocketed spring assembly 12, it may remain glued to the upper section 108 of the fabric of the pocketed spring assembly 12 and recycled together. Usually, this fabric is non-woven polypropylene. U.S. patent application Ser. No. 18/469,644, which is fully incorporated by reference herein, discloses a pocketed spring assembly having different sheets made of the same material as the fabric used to make the strings, including non-woven polypropylene fabric.

To ease the recycling at the end of life of a bedding or seating product, such as a mattress, the adhesive may be made of polypropylene, the fabric of the scrim sheet may be made of polypropylene, the fabric of the dimensionally stabilizing substrate may be made of polypropylene and the fabric used to create the strings may be made of polypropylene. Thus, after the separation of the metal of the pocketed spring assembly from the fabric, all of the fabric is may be made of polypropylene and may be quickly and easily recycled.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A bedding or seating product comprising:

a pocketed spring assembly comprising a plurality of strings of pocketed springs joined to a lower sheet, each of said strings of pocketed springs comprising metal springs inside fabric pockets, wherein each of said strings has a continuous loop of perforations at least partially around the string to facilitate tearing of the fabric pockets;

a cushion assembly comprising at least one foam layer and a connector sheet, the at least one foam layer and the connector sheet being sewn together, wherein the connector sheet of the cushion assembly is joined to at least some of the fabric pockets of the pocketed spring assembly.

2. The product of claim 1, wherein the connector sheet is made of the same material as the fabric pockets.

3. The product of claim 1, wherein said lower sheet of the pocketed spring assembly is made of the same material as the connector sheet of the cushion assembly.

4. The product of claim 1, wherein the lower sheet of the pocketed spring assembly and the connector sheet of the cushion assembly are made of non-woven polypropylene.

5. The product of claim 1, wherein at least some of the pocketed springs are glued together.

6. The product of claim 5, wherein the connector sheet of the cushion assembly and the fabric pockets and the lower sheet of the pocketed spring assembly are made of non-woven polypropylene and the glue is made at least partially of polypropylene.

7. The product of claim 5, wherein the connector sheet of the cushion assembly, the fabric pockets, the lower sheet of the pocketed spring assembly and the glue are made of the same base material.

8. A bedding or seating product comprising: a pocketed spring assembly comprising a plurality of parallel strings of springs joined together, each of said strings comprising a plurality of individually pocketed springs, each of said strings comprising a piece of fabric joined to itself along a longitudinal seam, first and second opposed plies of fabric being on opposite sides of the springs, a plurality of pockets being formed along a length of said string by transverse seams joining said first and second plies, at least one spring being positioned in each said pockets, a lower sheet attached to a lower surface of at least some of said strings, wherein each of said strings has a continuous loop of perforations fully around the string to facilitate tearing of the piece of fabric; a cushion assembly comprising multiple cushion layers including a connector sheet, the cushion layers being sewn together, wherein the connector sheet of the cushion assembly is attached to at least some of the strings of the pocketed spring assembly.

9. The product of claim 8, wherein at least one of the cushion layers is made of foam.

10. The product of claim 8, wherein the lower sheet of the pocketed spring assembly has a greater tensile strength than the tensile strength of the fabric of the strings of the pocketed spring assembly.

11. The product of claim 8, wherein the connector sheet, the fabric of the strings and the lower sheet are made of the same material to facilitate recycling.

12. The product of claim 8, wherein the connector sheet and the fabric of the strings are made of the same material to facilitate recycling.

13. The product of claim 8, wherein at least some of the cushion layers are made of foam.

14. A bedding or seating product comprising: a pocketed spring assembly comprising a plurality of parallel strings of springs joined together, each of said strings comprising a plurality of individually pocketed springs, each of said strings comprising a piece of fabric joined to itself along a longitudinal seam, first and second opposed plies of fabric being on opposite sides of the springs, a plurality of pockets being formed along a length of said string by transverse seams joining said first and second plies, at least one spring being positioned in each said pockets, a lower sheet attached to a lower surface of at least some of said strings, wherein each of said strings has a continuous loop of perforations fully around the string to facilitate tearing of the piece of fabric proximate the lower sheet in a lower third of the pocketed spring assembly; a cushion assembly comprising multiple cushion layers including a connector sheet, the cushion layers being sewn together, wherein the connector sheet of the cushion assembly is attached to at least some of the strings of the pocketed spring assembly.

15. The product of claim 14, wherein at least one of the cushion layers is made of foam.

16. The product of claim 14, wherein the lower sheet of the pocketed spring assembly has a greater tensile strength than the tensile strength of the fabric of the strings of the pocketed spring assembly.

17. The product of claim 14, wherein the connector sheet, the fabric of the strings and the lower sheet are made of the same material to facilitate recycling.

18. The product of claim 14, wherein the connector sheet and the fabric of the strings are made of the same material to facilitate recycling.

19. The product of claim 14, wherein each of the perforations extends through one of the plies.

* * * * *